United States Patent [19]

Wolff

[11] 4,258,674

[45] Mar. 31, 1981

[54] ENGINE FUEL INJECTION SYSTEM

[76] Inventor: George D. Wolff, P.O. Drawer, Winter Haven, Fla. 33880

[21] Appl. No.: 24,691

[22] Filed: Mar. 28, 1979

[51] Int. Cl.[3] ..... F02M 39/02; F02B 3/00

[52] U.S. Cl. ..... 123/446; 123/472; 123/478

[58] Field of Search ..... 123/139 E, 139 AF, 139 DP, 123/139 AP, 139 AW, 139 AT, 32 JV, 32 AE, 32 EA; 239/88-96

[56] References Cited

U.S. PATENT DOCUMENTS

| | | | |
|---|---|---|---|
| 2,605,141 | 7/1952 | Pyk et al. | 239/94 |
| 3,416,506 | 12/1968 | Steiger | 123/139 R |
| 3,605,703 | 9/1971 | Moulds | 123/32 EA |
| 3,913,537 | 10/1975 | Ziesche et al. | 239/96 |
| 3,952,711 | 4/1976 | Kimberley et al. | 123/139 AT |
| 4,036,192 | 7/1977 | Nakayama | 123/139 AT |
| 4,046,112 | 9/1977 | Deckard | 123/32 AE |
| 4,069,800 | 1/1978 | Kanda et al. | 123/139 A |
| 4,161,161 | 7/1979 | Bastenhof | 123/139 AT |

FOREIGN PATENT DOCUMENTS

| | | | |
|---|---|---|---|
| 443124 | of 0000 | United Kingdom . | |
| 841202 | 7/1960 | United Kingdom | 123/32 AE |

*Primary Examiner*—P. S. Lall

*Attorney, Agent, or Firm*—Duckworth, Hobby, Allen, Dyer & Pettis

[57] ABSTRACT

A fuel injection system for an internal combustion engine comprises an electronic control circuit which measures engine performance and generates an electrical output signal to control engine performance and includes a fuel pump for periodically transmitting pressurized pulses of fuel through a conduit to a fuel injector valve. A fuel injector valve is coupled to the electronic control circuit and to the conduit through which pressurized pulses of fuel are transmitted to convert the electrical signal into mechanical displacements between an open and a closed position to inject measured amounts of pressurized fuel into a cylinder of the engine at predetermined variable time intervals which are independent of the arrival or termination of the pressurized pulses of fuel at the fuel injector valve. Engine speed, injected fuel quantity, timing and other functions are electronically controlled by controlling the timing and duration of the opening and closing of the fuel injector valve.

59 Claims, 6 Drawing Figures

ENGINE FUEL INJECTION SYSTEM

BACKGROUND OF THE INVENTION

1. Field of the Invention

The present invention relates to a fuel injection system for an internal combustion engine, and more particularly, to a fuel injection system including a fuel pump which periodically transmits pressurized pulses of fuel from the fuel pump through a conduit to a fuel injection valve.

2. Description of the Prior Art

A wide variety of fuel injection systems include a cam driven fuel pump which periodically transmits pressurized pulses of fuel from the fuel pump through a conduit to one or more fuel injector valves. Typically these fuel injector valves are spring biased to a closed position and open when the pressure at the fuel injector valve exceeds a predetermined pressure level. As the amplitude of the pressure pulse present at the fuel injector valve decreases below a predetermined threshold level, the force provided by the spring bias closes the needle valve of the fuel injection valve and terminates the injection of fuel into an engine cylinder.

A 1936 United Kingdom patent specification Ser. No. 443,124 discloses an invention by Amery which relates to an improvement for fuel injection systems of the type described above. In the system disclosed by Amery the fuel injector valve is opened when the fuel pressure at the valve reaches a predetermined level. An auxiliary cam-operated control valve is provided to generate a fluid pressure which is applied to the back side of the fuel injector valve to forcefully close the injector valve at predetermined times independent of the fuel pressure at the discharge end of the fuel injector valve. In accordance with the Amery system, commencement of fuel injection depends on the timing of the mechanically driven fuel pump while the termination of the fuel injection depends on pressure applied to the closing piston within the fuel injector valve under the control of the cam operated control valve.

An inherent characteristic of engine speed driven fuel injection systems is that the pressure available for injection decays rapidly at low engine speeds due to the slower pumping action of the fuel pump.

U.S. Pat. No. 4,069,800 (Kanda et al) discloses a fuel injection system which utilizes accumulators to maintain a uniform fuel supply pressure at the fuel injector valve. A spring biased servo valve within the fuel injector valve controls the opening and closing of the fuel injector valve. U.S. Pat. No. 4,036,192 (Nakayama) discloses a related fuel injection system which is intended to eliminate dribbling of fuel from fuel injection nozzles following the termination of each fuel injection pulse.

U.S. Pat. No. 3,952,711 (Kimberley et al) discloses a fuel injection nozzle with independent opening and closing control. In this common rail system which utilizes an accumulator to provide a uniform source of fuel pressure at the fuel injection valve, the opening of the nozzle valve is controlled by a compression spring in a conventional manner, but an independent means is provided to control the nozzle valve biasing forces during opening and closing of the nozzle. U.S. Pat. No. 3,416,506 (Steiger) discloses another type of common rail fuel injector system which utilizes a pressure accumulator to maintain a uniform pressure level at the fuel injector valve.

SUMMARY OF THE INVENTION

The present invention contemplates a fuel injection system of internal combustion engines including a fuel pump for periodically transmitting pressurized pulses of fuel through a conduit and comprises electronic circuit means and fuel injector valve means. The electronic circuit means are coupled to the engine to measure engine performance and to generate an electrical output signal to control engine performance. The fuel injector valve means are coupled to the electronic circuit means and to the conduit for converting the electrical output signal into mechanical displacements between an open and a closed position to inject measured amounts of pressurized fuel into a cylinder of the engine at predetermined variable time intervals independent of the arrival or termination of the pressurized pulses of the fuel transmitted through the conduit to the fuel injector valve means.

An important aspect of the present system is the provision of a fuel injection pump which generates high pressure fuel pulses which are transmitted through a conduit to a remotely located fuel injection valve. The timing and duration of the fuel injection is controlled directly at the fuel injector valve independently of the arrival time or duration of the pressure pulse at the fuel injector valve.

Another important aspect of the present system is its ability to remain in the closed position for an independently controllable time interval after the arrival of the fuel pressure pulse at the fuel injector valve to permit the fuel pressure level at the fuel injection valve to reach at least a predetermined minimum value at low engine RPM by summing the pressure generated by reflections of multiple fuel pressure waves through the fuel line which extends between the fuel pump and the inlet of the fuel injection valve prior to commencement of the fuel injection.

DESCRIPTION OF THE DRAWINGS

The invention is pointed out with particularity in the appended claims. However, other objects and advantages together with the operation of the invention may be better understood by reference to the following detailed description taken in connection with the following illustrations wherein:

DESCRIPTION OF THE PREFERRED EMBODIMENT

In order to better illustrate the advantages of the invention and its contributions to the art, a preferred hardware embodiment of the invention will now be described in some detail.

Figure 1:
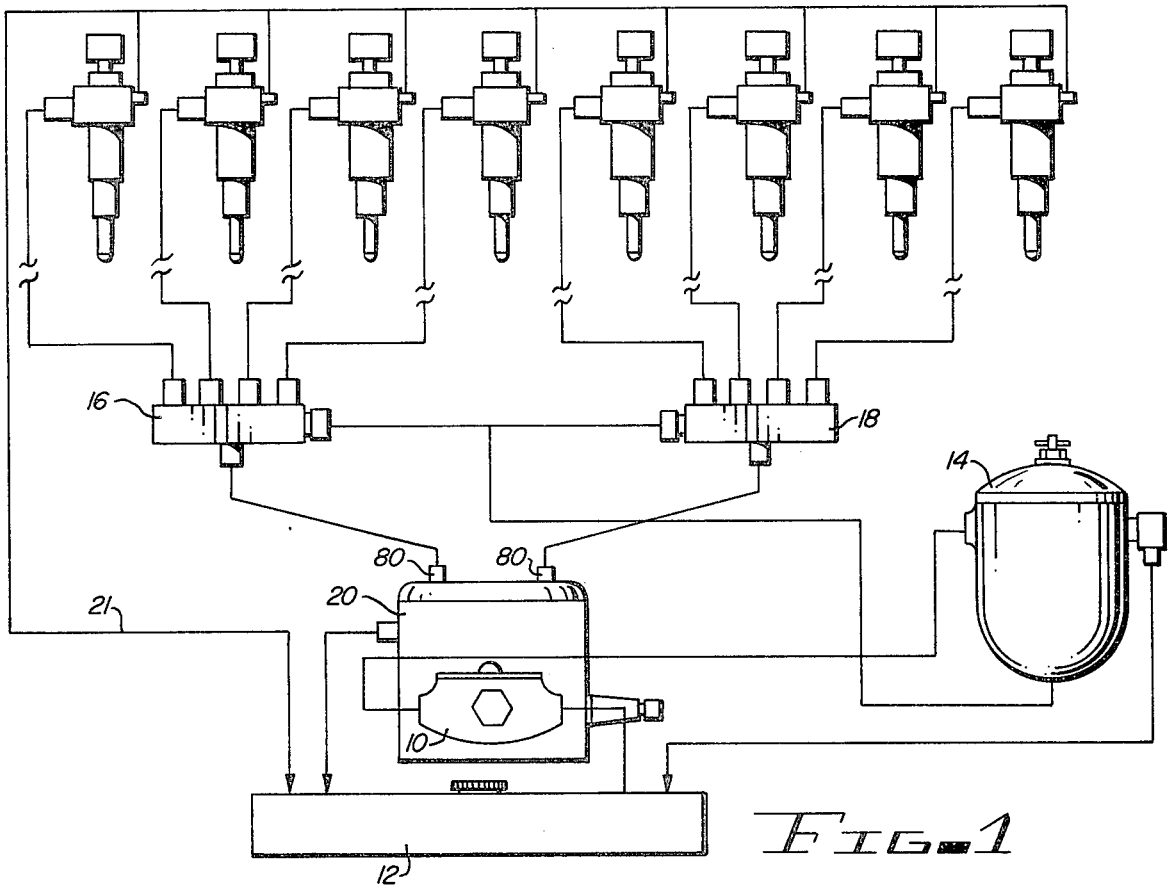
FIG. 1 is a schematic representation of the various elements of an eight cylinder embodiment of the present fuel injection system.

Referring now to FIG. 1, the system of the present invention is shown as it would be coupled to an eight cylinder internal combustion engine. A low pressure fuel supply pump 10 receives a supply of fuel from a fuel tank 12 and transmits fuel through a fuel filter 14 to a pair of fuel distributor blocks 16 and 18. A high pressure in-line fuel injection pump 20 receives a supply of fuel from fuel distributor blocks 16 and 18 and retransmits high pressure pulses of fuel to blocks 16 and 18 at periodic intervals. Pump 20 may be of the type commercially manufactured by Robert Bosch, American Bosch, or C.A.V. These commercially available pumps must be modified since the control racks, control mechanisms for control of the pump output and pump delivery valves are not necessary. Pump 20 should also be coupled to a cam shaft which is driven at engine speed and which includes two identical cam lobes per cam to produce two pumping strokes per engine revolution. The fuel pressure pulses are intermittently generated at time intervals due to the pumping strokes of the plunger of pump 20 which transmits fuel pressure pulses at the velocity of sound to distributor blocks 16 and 18 where the fuel pressure pulses are split into four parts and directed to the inlet of four separate fuel injection valves per distributor block. At an independently timed interval after the arrival of a fuel pressure pulse at a fuel injection valve, the fuel injection valve is electronically actuated by electronic circuit means (not shown) to meter a predetermined quantity of fuel from the fuel injector valve into the combustion chamber of the selected cylinder of the engine.

Figure 2:
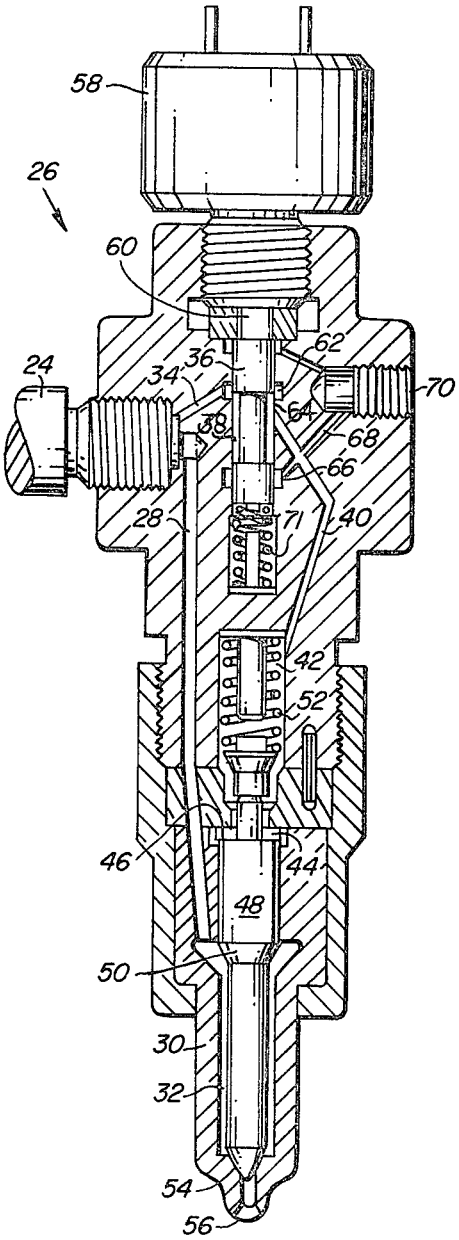
FIG. 2 is a sectional view of a fuel injector valve in accordance with the present invention.
Figure 3:
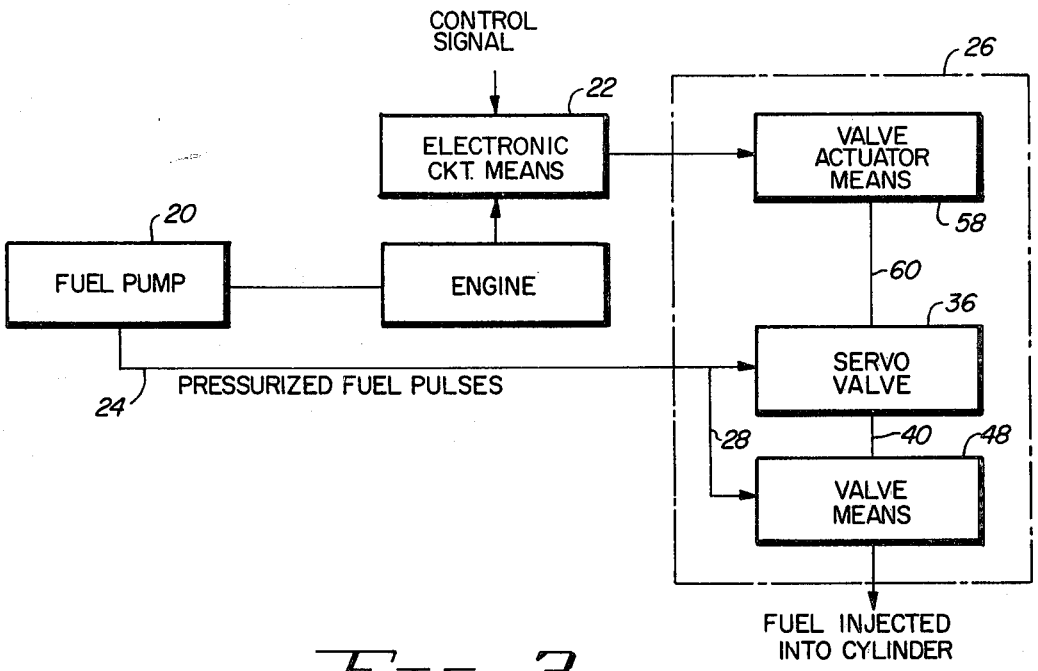
FIG. 3 is a block diagram representation of the various elements of the present invention.

Referring now to FIGS. 2 and 3, electronic circuit means 22 include engine performance sensor means for sensing various engine operating parameters such as temperature, engine RPM, manifold pressure, turbo charger discharge pressure, throttle position and one or more parameters representative of the emission level of various constituent elements of the engine exhaust. Electronic circuit means 22 also receives a control signal which is representative of the desired level for each sensed engine operating parameter. Electronic control means (not shown) is another subsystem of electronic circuit means 22 which receives the control signal and the output of the engine performance sensor means to generate an electrical output signal which regulates the operation of the remaining elements of the fuel injection system of the present invention to control engine performance by varying the timing and duration of the fuel injector output.

The electronic sensor means and feedback and control elements of electronic circuit means 22 are well known to those skilled in the art and have thus not been disclosed in specific detail.

Pressurized pulses of fuel periodically generated by the engine driven fuel pump are transmitted through conduit 24 to fuel injector valve 26. The fuel pressure pulse is channeled via passageway 28 into a conventional nozzle section 30 causing a pressure build up in the lower nozzle cavity 32. The fuel pressure pulse is also channeled via passageway 34 to servo valve 36 which is illustrated in FIG. 2 in the first position. In this first or open position, servo valve 36 permits the passage of pressurized fuel from passageway 34 through bore 38, and output port passageway 40 into spring chamber 42. Spring chamber 42 is in fluid communication with upper nozzle cavity 44 and is thus also in fluid communication with the first valve face 46 of needle valve or valve means 48. The second valve face 50 is positioned within lower nozzle cavity 32.

When servo valve 36 is in the first or open position as indicated in FIG. 2, first valve face 46 and second valve face 50 of valve means 48 are subjected to equal fluid pressures, but as a result of the greater surface area of first valve face 46 in comparison to the surface area of second valve face 50 and as a result of the downward spring bias force applied to first valve face 44 by biasing means or biasing spring 52, valve means 48 is maintained in firm contact with valve seat 54 and the passage of pressurized fuel from lower nozzle cavity 32 through metering orifices 56 into a cylinder of the engine is prevented.

When valve actuator means 58 is actuated by the electrical output signal from electronic circuit means 22, servo valve 36 is downwardly displaced by shaft 60 of actuator means 58. Valve actuator means 58 is a commercially available item of the type well known to those skilled in the art. The voice coil driver assembly of a V-10 servo valve manufactured by the Team Corporation of South El Monte, California, functions satisfactorily.

When servo valve 36 is downwardly displaced by shaft 60 of valve actuator means 58 into the second position, the larger diameter upper end section of servo valve 36 extends slightly below the lower cutoff point of valve land 62 which terminates the flow of pressurized fuel from passageway 34 through bore 38 to passageway 40. In the second position, the lower part of the larger diameter upper section of servo valve 36 is displaced about to the position indicated by reference number 64 and does not block the communication of passageway 40 with bore 38. In the second position the upper larger diameter section of the lower section of servo valve 36 is displaced to a point below the upper portion of land 66 permitting pressurized fuel from spring chamber 42 to flow through passageway 40, bore section 38, valve land 66 and through fuel discharge passage 68. A fuel discharge conduit is coupled to discharge port 70 to permit the discharged fuel to be returned to the fuel tank.

Electronic circuit means 22 energizes valve actuator means 58 to reposition servo valve 36 into the second position while a fuel pressure pulse is still present at the fuel injector valve 26. Thus high pressure fuel is still present in lower nozzle cavity 32, but is being discharged through passageway 40 from the first face 46 of valve means 48. The pressure exerted by the pressurized fuel on the second face 50 of valve means 48 overcomes the downward biasing force exerted by spring 52 and causes valve means 48 to be displaced in an upward direction which opens valve means 48 and permits a flow of pressurized fuel through fuel metering orifices 56 into an engine cylinder.

After a predetermined time interval determined by electronic circuit means 22, an appropriate electrical output signal is transmitted to valve actuator means 58 to de-energize it and permit servo valve 36 to be returned by biasing spring 71 to the first or open position. High pressure fuel is then retransmitted through output port 40 into spring chamber 42 causing valve means 48 to be displaced in a downward direction which closes the valve 48 and terminates the flow of fuel from lower nozzle cavity 32. In this manner, the fuel injection is terminated while the pressure in lower nozzle cavity 32 remains essentially unchanged from the time when the injection was initiated. The maintenance of a high, essentially uniform pressure differential across fuel metering orifices 56 during the entire fuel injection period produces a favorable rate of fuel flow and a good atomization and fuel distribution pattern within the cylinder which maximizes engine performance.

In certain applications it may be desirable to decrease the rate in which valve means 48 is displaced to more gradually increase the fuel quantity injected to the combustion chamber versus time. This effect can be readily accomplished by either modulating the displacement of shaft 60 of valve actuator means 58 to control the rate of displacement of servo valve 36 or by sizing fuel discharge port 68 to effect a more gradual pressure decrease in spring chamber 42 and upper nozzle cavity 44 when servo valve 36 is displaced into the second position. Electromagnetic valve actuator means 50 can be modulated in other ways to affect the combustion process and engine performance.

Figure 4:
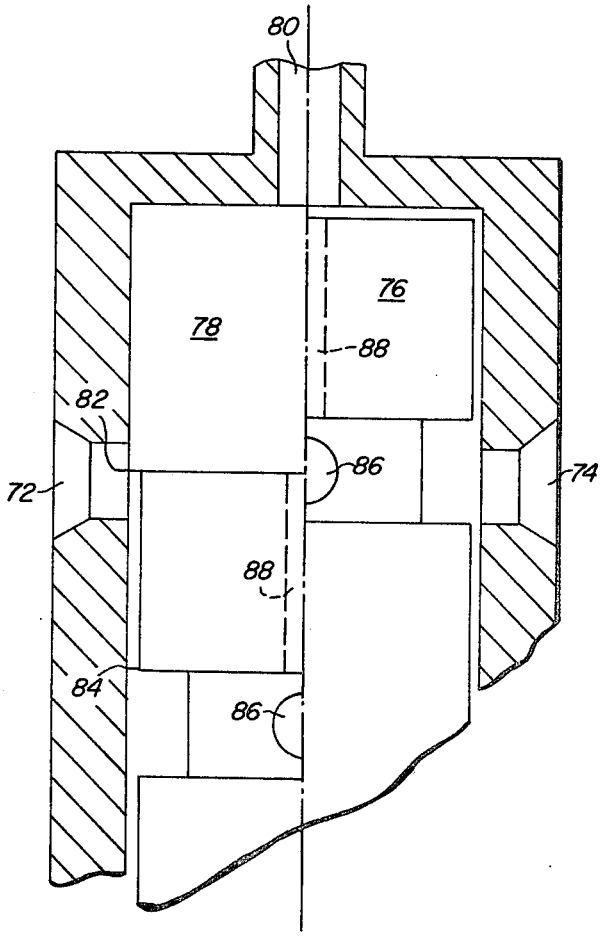
FIG. 4 is a partial sectional view of a fuel injector pump which is utilized in connection with the system of the present invention.

Turning now to FIG. 4, a partial sectional view of a plunger and cylinder of a pump of the type which is suitable for use in connection with the present invention is illustrated. The plunger is shown at the beginning of its pumping stroke in the left hand side of the cut away and at the end of its pumping stroke in the right hand side of the cut away. The pump includes fuel ports 72 and 74 which are on diametrically opposed sides of the pump cylinder.

When pump plunger 76 is in the lower position shown in the left hand side of FIG. 4, fuel ports 72 and 74 are partially exposed which permits fuel from low pressure fuel supply pump 10 to flow from fuel distributor blocks 16 and 18 through fuel outlet 80, pumping chamber 78 and out of fuel ports 72 and 74. This fuel flow pattern scavanges pumping chamber 78 and removes any vapor and air bubbles which may have formed in the chamber during the preceeding downward stroke of plunger 76.

When actuated by a cam (not shown), plunger 76 begins its upward movement which causes valve land 82 to close off fuel ports 72 and 74 (port closing). At this point the fuel in pumping chamber 78 begins to be pressurized and is discharged through fuel outlet 80, commencing the generation of a fuel pressure pulse which is transmitted from fuel outlet 80 through a conduit to one of the fuel distributor blocks 16 and 18. After a predetermined upward displacement, lower land 84 of piston 76 overrides the lower edge of fuel ports 72 and 74 (port) opening) which establishes fluid communication between fuel ports 72 and 74 and cross-hole 86. A drain path is thus opened which permits fuel to flow from the pressurized pumping chamber 78 through passageway 88 and cross-hole 86 and to be discharged through fuel ports 72 and 74 as is shown in the right hand side of FIG. 4.

The initial establishment of fluid communication between fuel ports 72 and 74 and cross-hole 86 terminates the effective pumping stroke, but the plunger continues its upward travel at a decelerated rate until it stops in its upper most position as illustrated in the right hand side of FIG. 4.

During the following down stroke of plunger 76, fuel flows from fuel outlet 80 into pumping chamber 78, and during the initial part of the down stroke fuel also flows through fuel ports 72 and 74 via cross-hole 86 and passageway 88 into pumping chamber 78. At the end of the downward displacement of plunger 76, land 82 will pass below the upper portion of ports 72 and 74 permitting fluid communication between the fuel ports and pumping chamber 78 as was previously explained. Since pumping chamber 78 is being filled during the entire downward stroke of plunger 76 it is not necessary to fully expose fuel ports 72 and 74 at the end of the stroke which permits a reduction in the overall plunger lift displacement required for the proper pump operation.

In order to limit the discharge of fuel from the high pressurized fuel lines into pumping chamber 78, it may be desirable to provide a pressure responsive valve at fuel outlet 80 of the fuel pump to maintain at least a minimum predetermined pressure level within the fuel lines. This pressure level would be slightly less than the pressure of the fuel supplied by fuel supply pump 10. Pressure release valves of this type are well known to those skilled in the art and are commercially available from companies such as Robert Bosch.

In connection with the operation of the fuel injection pump 20 as disclosed in FIGS. 1 and 4, a supply of low pressure fuel is circulated through fuel distributor blocks 16 and 18 and through fuel outlets 80 into the pumping chamber 78 of fuel pump 20. In another embodiment of the invention, fuel can be provided to the system by coupling a supply of fuel under low pressure to the fuel drain line designated by reference number 21 in FIG. 1. In this embodiment a one-way check valve is coupled to discharge port 70 of each individual fuel injector valve and each fuel injector valve includes an additional passageway (not shown) between discharge port 70 and fuel inlet passageway 28. This configuration permits low pressure fuel to flow through the one-way check valve into passageway 28 whenever a fuel pressure pulse is not present at the high pressure input of the fuel injector valve. The flow of low pressure fuel through the one-way check valve may also be coupled through a passageway extending from discharge port 70 into lower nozzle cavity 32. This configuration permits a flow of ambient temperature fuel to be circulated through valve means 48 to cool the needle valve in a manner well known to those skilled in the art.

The lower part of piston 76 in the vincinty of land 84 may be conically tapered or stepped down in diameter to more gradually terminate the fuel pressure pulse to prevent cavitation and the formation of air bubbles in the system. Alternatively, a smaller diameter orifice may be provided in passageway 88 to accomplish an equivalent result.

Figure 5:
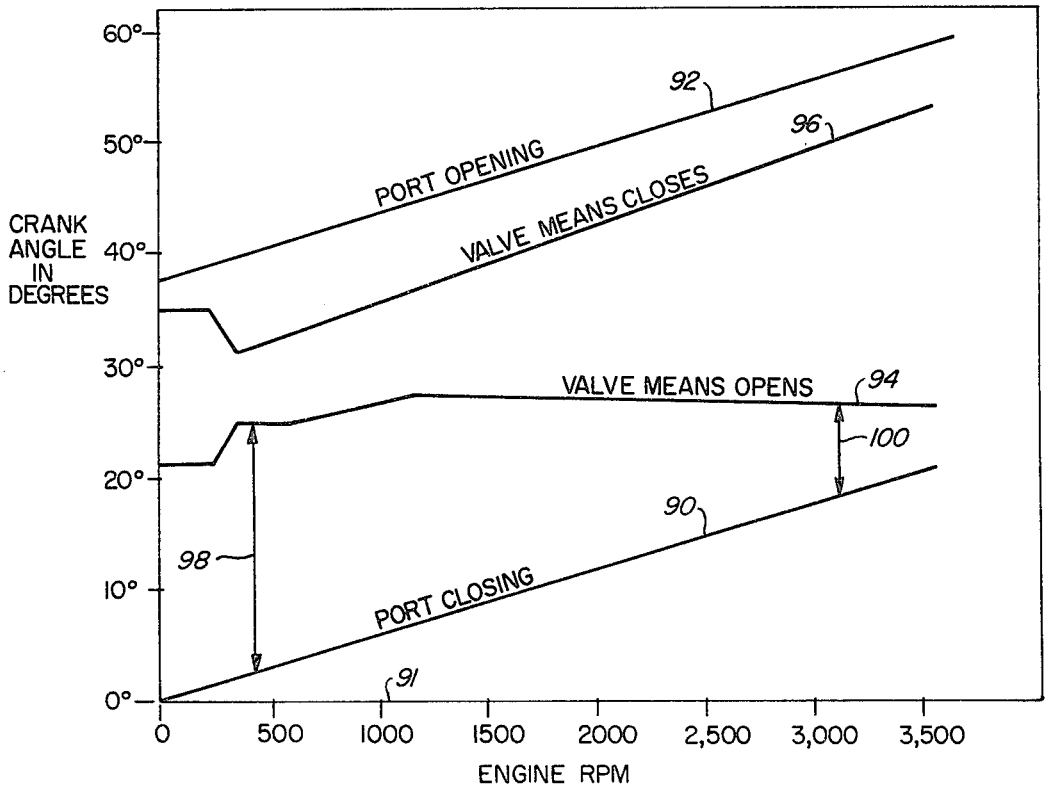
FIG. 5 is a timing diagram illustrating the relative timing between the fuel injection pump and the opening and closing of the fuel injection valve.

Referring now to FIG. 5, a plot of the time relationship between the various events occurring during the operation of the fuel injection system of the present invention is illustrated. Port closing line 90 identifies the arrival of the pressure pulse at injector 26. Each pressure pulse is generated when fuel ports 72 and 74 are closed off by land 82 of plunger 76. X-axis 91 represents port closing at the fuel pump. The vertical distance between the X-axis 91 and port closing line 90 corresponds to the travel time of the fuel pressure pulse from the pump to the injector. Port opening line 92 identifies the arrival of the end of the pressure pulse at injector 26. This termination was caused by the opening at the pump. Lines 94 and 96 illustrate one possible fuel injection timing schedule which can be implemented by the electronic circuit means 22 of the present invention to open and close valve means 48 to meter predetermined quantities of fuel at predetermined variable times in relation to crank shaft angle and engine RPM.

The length of the line designated by reference number 98 corresponds to the time interval at 500 RPM between the generation of the leading edge of a single high pressure fuel pulse by the fuel pump and the initial opening of valve means 48. This substantial time interval between port closing and the opening of valve means 48 permits a single fuel pressure pulse to travel from the engine driven fuel pump through a conduit to the fuel injection valve 26 several times. The standing waves created by the numerous reflections of the high pressure fuel pulse between fuel injector valve 26 and the engine driven fuel pump permit the fuel pressure at the entrance of fuel injector valve 26 to be substantially magnified as the result of the summation of the various standing wave amplitudes. Therefore, at low speeds, the effective fuel pressure at fuel injection valve 26 may be a multiple of the fuel pressure generated by the engine driven fuel pump. Thus a uniformly high fuel pressure can be maintained at fuel injector 26 over the entire speed range to maintain a uniform spray pattern and a uniform quantity of fuel flow per unit of time for all engine operating conditions. The maximum available engine torque can be limited by electronically preprogramming the shape and limits of line 96. This limits the maximum quantity of fuel injected into a cylinder at a particular engine speed thereby limiting the maximum available torque.

The time delay between the port closing line 90 and the opening of valve means 48 as indicated by the line designated by reference number 100 is shorter at higher engine RPM since the pulse generated by the engine driven fuel pump requires a greater number of crank angle degrees at higher engine RPM than at lower engine RPM to arrive at the injector valve 26. Therefore, the effect of the standing waves to multiply the effective fuel pump pressure is most prevalent at low engine RPMs where it is most needed because of the low amplitude of the pressure wave and diminishes with increasing RPM where it is not needed because of the high amplitude of the pressure wave generated by the pump.

Figure 6:
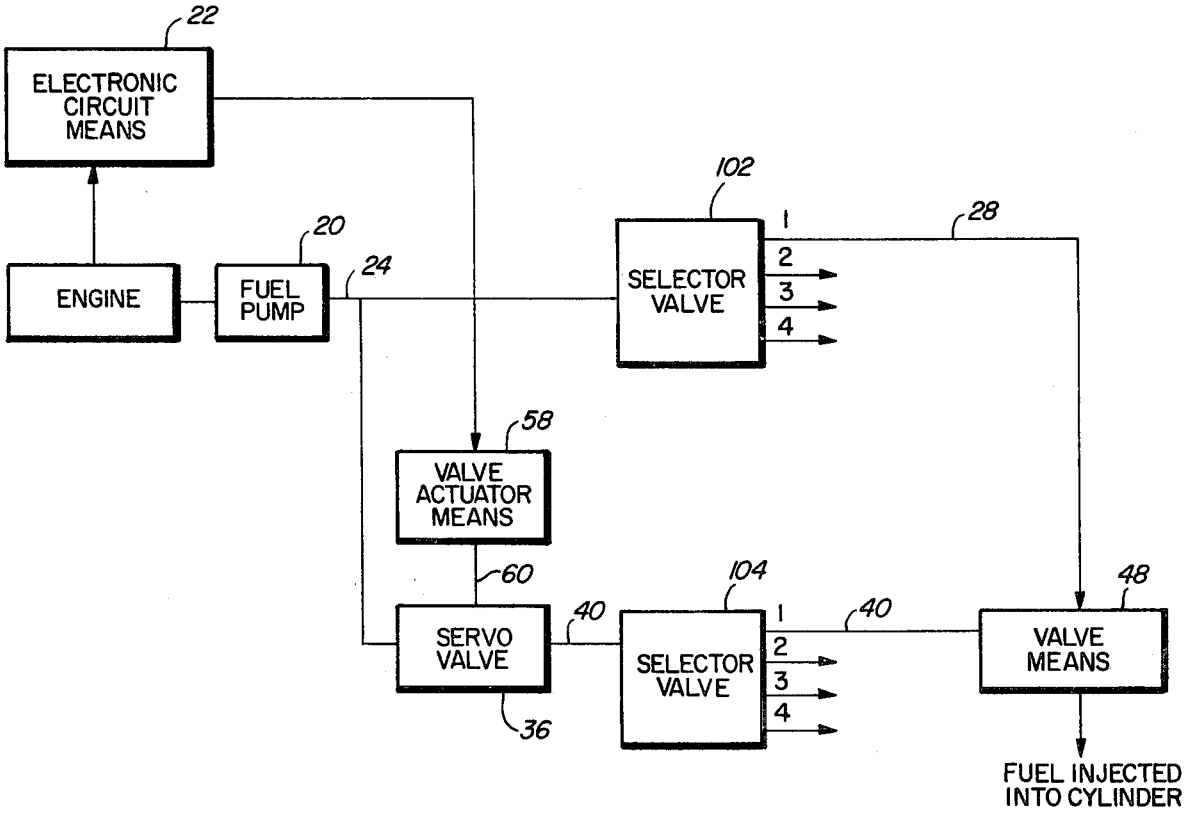
FIG. 6 is a block diagram representation of an alternative embodiment of the present invention.

Referring now to FIG. 6, an alternative embodiment of the fuel injection system of the present invention is disclosed. The particular embodiment illustrated operates in conjunction with a four cylinder diesel engine. A single valve means 28 is coupled to each of the four cylinders of the engine. A single valve actuator means 48 and servo valve 36 are provided for the entire system and are remotely located from the four valve means 48. Fuel selector valve 102 is coupled between conduit 24 and inlet passageway 28 of valve means 48 while fuel selector valve 104 is coupled in series with exit passageway 40. Selector valves 102 and 104 are driven by a shaft which is synchronized with the rotational position of the engine. The selector valves mechanically direct the flow of fuel arriving at their inlet sides sequentially to the four cylinders of the engine. If the firing order of a particular engine is 1, 2, 3, 4, then selector valves 102 and 104 will selectively direct pressurized fuel pulses to the engine cylinder in that sequence. Selector valves 102 and 104 are both coupled to simultaneously direct fuel pressure pulses to the same valve means 48.

Low pressure fuel supply 10 is coupled to direct fuel under pressure to selector valve 102 and provides fuel to the system in a manner similar to that described in connection with fuel distributor blocks 16 and 18. The remaining elements of the system illustrated in FIG. 6 are essentially unchanged from those described above in connection with the other figures. The primary advantage of the system of FIG. 6 is that the cost of the mechanical hardware of the system is substantially reduced. Selector valves 102 and 104 are comparatively inexpensive and only a single valve actuator means 40 and a single servo valve 36 are required for the entire system.

It will be apparent to those skilled in the art that the disclosed engine fuel injection system may be modified in numerous ways and may assume many embodiments other than the preferred form specifically set out and described above. For example, valve actuator means 58 may be electrically controlled, but actuated either hydraulically or pneumatically to control the operation of fuel injector valve 26.

Electronic circuit means 22 of the present invention may be specifically programmed to partially or fully withold fuel injection from selected cylinders to influence the oscillatory torsional behavior of the engine or of the mass elastic system of which the engine is an element. Fuel injection may for periods of time be witheld from selected cylinders to permit the remaining cylinders to operate at a higher load at the same total engine output load. Fuel injection may be alternately witheld from different cylinders to equalize the temperature and other engine operating parameters.

Accordingly, it is intended by the appended claims to cover all such modifications of the invention which fall within the true spirit and scope of the invention.

I claim:

1. A fuel injection system for an internal combustion engine including a fuel pump for periodically transmitting pressurized pulses of fuel through a conduit, said system comprising:

a. electronic circuit means coupled to the engine for measuring engine performance and for generating an electrical output signal to control engine performance; and b. fuel injector valve means coupled to said electronic circuit means and to said conduit for converting the electrical output signal into mechanical displacements between an open and a closed position to inject measured amounts of pressurized fuel into a cylinder of said engine at predetermined variable time intervals independent of the arrival or termination of the pressurized pulses of fuel transmitted through the conduit to the fuel injector valve means.

2. The fuel injection system of claim 1 further including second fuel injector valve means coupled to said electronic circuit means and to said conduit for converting the electrical output signal into mechanical displacements between an open and a closed position to inject measured amounts of pressurized fuel into a second cylinder of said engine at predetermined variable time intervals independent of the arrival or termination of the pressurized pulses of fuel transmitted through the conduit to said second fuel injector valve.

3. The system of claim 2 wherein said electronic circuit means selectively opens either said fuel injector valve means or said second fuel injector valve means at independently controllable times during the presence of a fuel pressure pulse to selectively inject measured amounts of pressurized fuel into said cylinder and said second cylinder at independently controllable times.

4. A fuel injection system for an internal combustion engine including a fuel pump for periodically transmitting pressurized pulses of fuel through a conduit, said system comprising:

a. electronic circuit means coupled to the engine for measuring engine performance and for generating an electrical output signal to control engine performance;

b. valve actuator means coupled to said electronic circuit means for converting the electrical output signal into mechanical displacements between a first and second position;

c. a servo valve coupled through the conduit to said fuel pump and displaceable by said valve actuator means between a first and a second position for transmitting pressurized fuel through an exit passageway when in the first position and for receiving pressurized fuel through the exit passageway when in the second position; and d. valve means having a first valve face coupled to the exit passageway of said servo valve and a second valve face coupled through the conduit to said fuel pump for opening said valve means to inject pressurized fuel into a cylinder of said engine when pressurized fuel is both applied to the second face of said valve means by said fuel pump and discharged from the first face of said valve means by the exit passageway of said servo valve.

5. The system of claim 4 wherein said electronic circuit means includes engine performance sensor means coupled to said engine for sensing various performance parameters of said engine.

6. The system of claim 5 wherein said electronic circuit means further includes electronic control means coupled to said engine performance sensor means for generating the electrical output signal in response to various engine performance parameters and a control signal.

7. The system of claim 6 wherein the opening time of said valve means is controlled by said electronic control means to limit the quantity of fuel injected into the cylinder as a function of engine speed.

8. The system of claim 6 wherein the initial opening of said valve means is controlled by said engine control means as a function of speed and load commensurate with the engine timing requirements.

9. The system of claim 6 wherein the closing of said valve means is preprogrammed in accordance with a predetermined torque curve stored in said electronic control means and said torque curve can be modified in response to various engine performance parameters.

10. The system of claim 5 wherein said engine performance sensing means measures engine RPM.

11. The system of claim 10 wherein said engine performance sensor means measures throttle position.

12. The system of claim 10 wherein said engine performance sensor means measures manifold pressure.

13. The system of claim 10 wherein said engine performance sensor means measures engine temperature.

14. The system of claim 4 wherein said servo valve is biased to the first position.

15. The system of claim 14 wherein said servo valve is biased to the first position by a spring.

16. The system of claim 4 wherein said servo valve includes a fuel discharge passage for draining fuel transmitted from the first face of said valve means through the exit passageway of said servo valve.

17. The system of claim 16 wherein a cross sectional area of said fuel discharge passage controls the rate at which said valve means opens.

18. The system of claim 4 wherein said valve actuator means is electrically controlled and hydraulically actuated.

19. The system of claim 4 wherein said valve actuator means is electrically controlled and pneumatically actuated.

20. The system of claim 4 wherein said valve actuator means is electronically controlled and electrically actuated.

21. The system of claim 4 wherein said valve actuator means includes an electrical solenoid having a shaft displaceable between the first and the second position.

22. The system of claim 4 wherein said valve means is biased to the closed position.

23. The system of claim 22 wherein said valve means is biased to the closed position by biasing means coupled to the first face of said valve means.

24. The system of claim 23 wherein said biasing means includes a spring.

25. The system of claim 22 wherein the metering of fuel into the cylinder occurs independently of the arrival or termination of a fuel pressure pulse at said valve means.

26. The system of claim 25 wherein the pressurized fuel is applied to the first face of said valve means to close said valve means when said servo valve is displaced into the first position.

27. The system of claim 26 wherein pressure is relieved from the first face of said valve means when the servo valve is displaced into the second position.

28. The system of claim 4 wherein the cross sectional area of the output port of said servo valve affects the rate of opening and closing of said valve means.

29. The system of claim 4 wherein the pressurized pulses of fuel are generated by mechanical pumping means.

30. The system of claim 29 wherein said pumping means includes a cam-actuated plunger.

31. The system of claim 30 wherein said pumping means includes a cam shaft and wherein said cam shaft includes a plurality of cams having identical cam lobes.

32. The system of claim 31 wherein said engine includes a crank shaft and wherein said pumping means cam shaft is rotationally driven in cyclic relationship with said engine crank shaft.

33. The system of claim 32 wherein said pumping means cam shaft rotates at one half the RPM of the engine crank shaft RPM.

34. The system of claim 32 wherein said pumping means cam shaft rotates at the same speed as the engine crank shaft.

35. The system of claim 32 wherein said pumping means cam shaft rotates at one and one-half the RPM of the engine crank shaft RPM.

36. The system of claim 32 wherein said pumping means cam shaft rotates at two times the RPM of the engine crank shaft RPM.

37. The system of claim 31 wherein said pumping means comprises a plunger and a pumping chamber having a fuel port connecting said pumping chamber with a fluid storage chamber vented to drain.

38. The system of claim 37 wherein said plunger having the initial part of its pumping stroke entraps a predetermined volume of fuel in said pumping chamber by closing off said fuel port.

39. The system of claim 38 wherein said plunger during a second part of its pumping stroke opens said fuel port to couple said pumping chamber with said fluid storage chamber to relieve the pressure from said pumping chamber.

40. The system of claim 37 wherein said fluid storage chamber of said mechanical pumping means contains a throttling orifice.

41. The system of claim 37 wherein the vent of said fluid storage chamber contains an overflow valve.

42. The system of claim 37 wherein said pumping chamber is directly coupled to said conduit.

43. The system of claim 37 wherein said pumping chamber is coupled to said conduit by a pressure responsive valve which maintains a minimum pressure differential between said conduit and said pumping chamber.

44. The system of claim 4 including a fuel distributor block coupled in series with said conduit at a point between said fuel pump and said servo valve.

45. The system of claim 44 wherein said fuel distributor block includes a one way check valve having an input coupled to a low pressure fuel supply source for permitting fuel flow from said fuel source into said fuel distributor block when the pressure in the fuel distributor block is less than the pressure at the input of said one way check valve.

46. The system of claim 4 further including a plurality of valve means and wherein each of said valve means is coupled to inject fuel into separate cylinders of said engine.

47. The system of claim 46 further including:

a. first selector valve means synchronized with the rotational position of said engine for selectively channeling fuel pressure pulses from said fuel pump through said conduit to the second valve face of selected ones of said valve means; and b. second selector valve means synchronizied with the rotational position of said engine and coupled to the exit passageway of said servo valve for establishing fluid communication between said servo valve and the first valve face of selected ones of said valve means.

48. The system of claim 47 wherein said first and second selector valve means comprise rotary valves rotationally driven in synchronization with the rotation of said engine.

49. The system of claim 48 wherein said rotary valves are mechanically driven by a rotational member of said engine.

50. A fuel injection system for an internal combustion engine including a fuel pump for periodically transmitting pressurized pulses of fuel through a conduit, said system comprising:

a. engine performance sensor means coupled to said engine for sensing various performance parameters of said engine and generating an engine performance signal;

b. electronic control means coupled to said engine performance sensor means for receiving the engine performance signal and a control signal and for generating an electrical output signal;

c. valve actuator means coupled to said electronic control means for converting the electrical output signal into mechanical displacements between a first and a second position;

d. a servo valve coupled through the conduit to said fuel pump and displacement by said valve actuator means between a first and a second position for transmitting pressurized fuel through an exit passageway when in the first position and for receiving pressurized fuel through the exit passageway when in the second position; and e. valve means having a first valve face coupled to the exit passageway of said servo valve and a second valve face coupled through the conduit to said fuel pump for injecting measured amounts of pressurized fuel into a cylinder of said engine when pressurized fuel is both applied to the second face of said valve means by said fuel pump and discharged from the first face of said valve means by the exit passageway of said servo valve and for terminating the injection of pressurized fuel into the cylinder when the servo valve is displaced into the second position;

whereby a measured amount of pressurized fuel is injected into the cylinder of said engine at predetermined variable time intervals independent of the arrival or termination of the pressurized pulse of fuel at said valve means.

51. The system of claim 50 wherein said engine includes a plurality of cylinders and said electronic control means generates an electrical output signal which withholds the injection of fuel from selected compression strokes of selected cylinders.

52. A method of injecting a measured quantity of fuel into a cylinder of an internal combustion engine at predetermined variable time intervals comprising the steps of:

a. generating pressurized pulses of fuel at time intervals having fixed relationship to the position of the engine crank shaft;

b. transmitting the pressurized pulses of fuel through a conduit to a fuel injector valve;

c. comparing actual engine operating parameters with desired engine operating parameters to generate an injector control signal; and d. opening the fuel injector valve a predetermined controllable time after the fuel pressure pulse has arrived at the fuel injector valve in response to the injection control signal and closing the fuel injector valve after a predetermined desired injection time in response to the injection control signal independent of the arrival or termination time of the fuel pressure pulse at the fuel injector valve.

53. The method of claim 52 wherein the time interval between the initial arrival of each fuel pressure pulse at the fuel injector valve and the opening of the fuel injector valve permits the fuel input pressure at the fuel injector valve to be substantially increased as a result of the summation of pressures produced by standing waves reflected between the output of the fuel injector pump and the input of the fuel injector valve.

54. The method of claim 53 including the step of electronically comparing actual engine operating parameters with desired engine operating parameters to generate an injection control signal.

55. The method of claim 53 including the step of utilizing fuel pressure to both open and close the fuel injector valve.

56. The method of claim 54 wherein the fuel injector valve is biased to the closed position.

57. The method of claim 56 including the step of converting the injector control signal into mechanical displacement of a servo valve between a first and a second position.

58. The method of claim 57 including the step of selectively coupling a first face of the fuel injector valve to the conduit and directly coupling a second face of the fuel injector valve to the conduit to create to create a force imbalance between the first and second valve faces of the fuel injector valve which selectively opens and closes the fuel injector valve in response to the mechanical displacements of the servo valve between the first and second positions.

59. The method of claim 58 including the step of utilizing fuel pressure to multiply the force created by the mechanical displacements of the servo valve between the first and second positions to open and close the fuel injector valve.

* * * * *